United States Patent [19]

Lofman

[11] 4,369,754

[45] Jan. 25, 1983

[54] VACUUM RESPONSIVE INJECTION SYSTEM FOR ENGINES

[76] Inventor: Bob Lofman, P.O. Box 128, Grass Valley, Calif. 95945

[21] Appl. No.: 203,854

[22] Filed: Nov. 4, 1980

[51] Int. Cl.[3] ..... F02M 12/22

[52] U.S. Cl. ..... 123/573; 123/572; 123/198 A

[58] Field of Search ..... 123/252, 572, 573, 1 A, 123/198 A

[56] References Cited

U.S. PATENT DOCUMENTS

| | | | |
|---|---|---|---|
| 1,091,843 | 3/1914 | Hogg | 123/198 A |
| 1,138,828 | 5/1915 | Adams | 123/198 A |
| 1,550,967 | 8/1925 | Kelty | 123/198 A |
| 1,858,392 | 5/1932 | Davis | 123/198 A |
| 2,281,695 | 5/1942 | James et al. | 123/198 A |
| 2,652,818 | 9/1953 | Pierce | 123/198 A |
| 3,557,763 | 1/1971 | Probst | 123/198 A |
| 3,716,040 | 12/1973 | Herpin | 123/198 A |

FOREIGN PATENT DOCUMENTS

| | | | |
|---|---|---|---|
| 566076 | 2/1924 | France | 123/573 |

*Primary Examiner*—Ronald H. Lazarus
*Attorney, Agent, or Firm*—Victor J. Evans & Co.

[57] ABSTRACT

A vacuum responsive injection system for engines which includes a vacuum conduit extending from a carburetor to a crankcase ventilation valve, injection means in said vacuum conduit connected to a metering means through a tube, the metering means is operatively attached to a liquid containing reservoir having an alcohol water mixture, the metering means includes an air bleed which allows the ratio of liquid to air to be finely varied so that upon demand by the engine through the vacuum, the fluid formed from alcohol, water and air mist can be introduced within the engine for increased mileage, less oil consumption, and removal of carbon.

9 Claims, 5 Drawing Figures

FIG 1
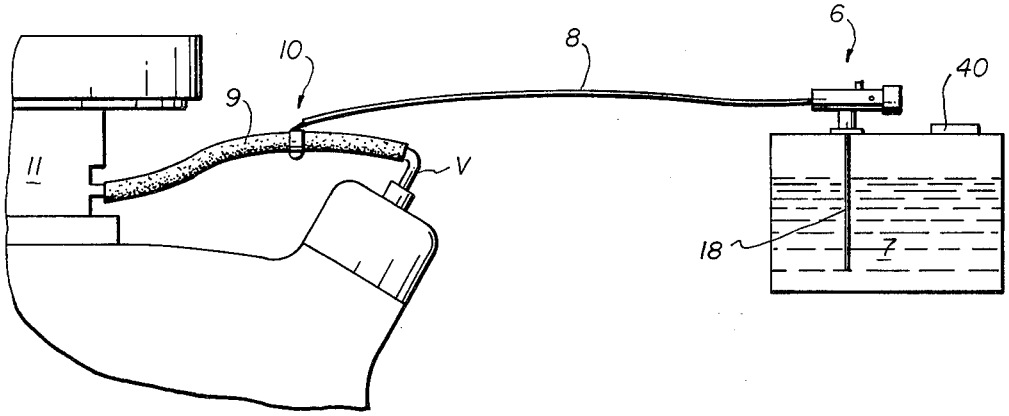
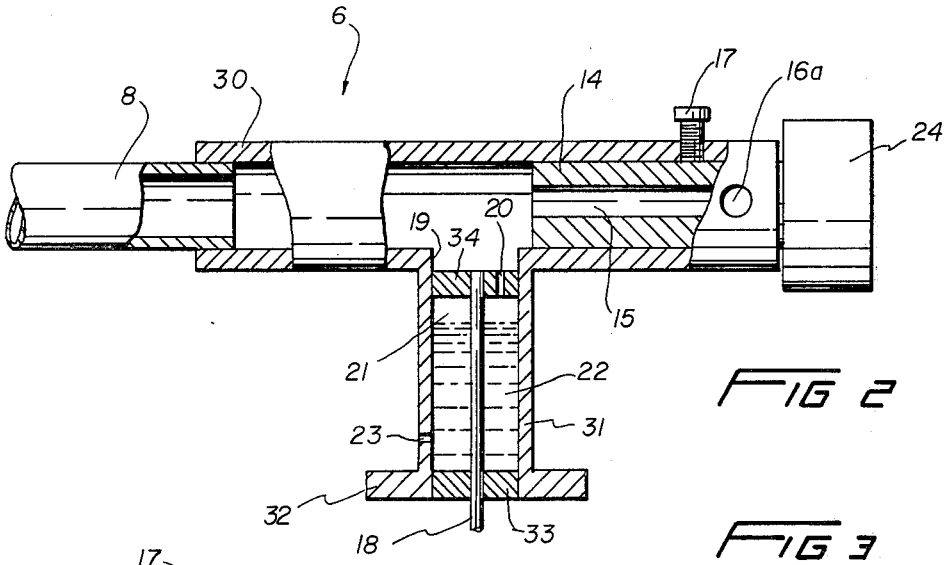
FIG 2
FIG 3
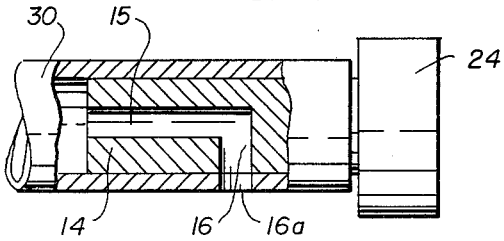
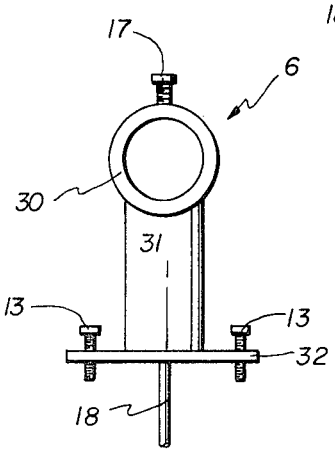
FIG 4
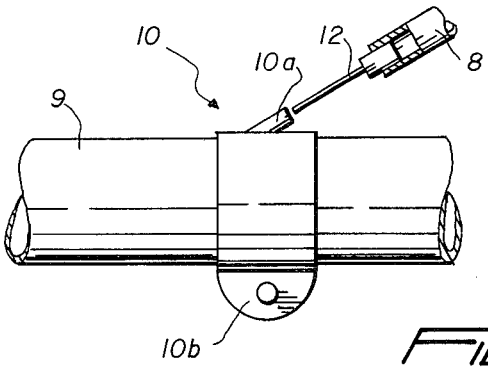
FIG 5

VACUUM RESPONSIVE INJECTION SYSTEM FOR ENGINES

BACKGROUND OF THE INVENTION

This invention relates generally to a device which adds a minute mixture of air, water and alcohol on demand by an engine vacuum to the unburned gases created by blow-by, that is oil mist and gases that pass beyond the rings of an engine and are entrained in the crankcase system. In the recent past, closed crankcase ventilation systems have been employed in order to minimize the amount of these noxious vapors being emitted into the atmosphere. Concomitantly, these substances, while being injected back into the engine for further burning have in many cases fouled the engine thereby reducing the life of sparkplugs, rings and the like.

The following appears to reflect the state of the art which applicant is aware in so far as these references appear to be relevant to the patent process: U.S. Pat. Nos. 3,673,997 Sawada, 3,750,634 Nakajima et al, 3,769,798 Whittaker, 3,834,365 Ussery, 3,908,617 Partridge, 4,011,846 Gagliardi, 4,089,309 Bush.

While all of these patents relate to anti-pollution measures for exhaust gas or crankcase emissions, none of the references teach, suggest, or render obvious that which is defined as the invention in the instant application.

SUMMARY AND OBJECTS OF THE INVENTION

Accordingly, it is an object of this invention to provide a vacuum responsive injection system for engines which is relatively inexpensive to manufacture, readily adaptable to existing engines, and extremely reliable and safe in use.

It is a further object of the invention to provide a device of the character described above in which the ratio of alcohol, water and air can be accurately modified in order to increase the effective horsepower of an engine and at the same time clean the internal components of the engine to such an extent that oil consumption is reduced as well as gas consumption.

It is yet a further object of this invention to provide a device of the character described above which includes a mechanism that takes into account cold engine conditions by not letting excess alcohol and water to build up in the line after the engine has been last used.

It is yet a further object of this invention to provide a device of the character described above which provides substantial benefits while only using a minute mixture of air, water and alcohol which are premixed with oil-carbon crankcase vapors before they enter the carburetor.

These and other object will be made manifest when considering the following detailed specification when taken in conjunction with the appended drawing figures.

BRIEF DESCRIPTION OF THE DRAWING FIGURES

FIG. 1 is a schematic view of the apparatus according to the present invention.

FIG. 2 is a sectional view in part of the metering means shown in the right hand portion of FIG. 1.

FIG. 3 is a detailed sectional view of the right hand portion of FIG. 2.

FIG. 4 is a end view of the left hand side of FIG. 2.

FIG. 5 is a detailed partially sectional view of the injection nozzle show in the left hand portion of FIG. 1.

BRIEF DESCRIPTION OF THE PREFERRED EMBODIMENTS

Referring to the drawings now, wherein like reference numerals refer to like parts throughout the various drawing figures, reference numeral 10 is directed to the injection means according to the present invention, and reference numeral 6 is directed to the metering means.

The metering means 6 includes a horizontal chamber 30 communicating with a vertical chamber 31 to generally define a T-shaped device and it is shown in FIG. 1 that the lowermost portion of the vertical chamber 31 is provided with a radially extending flange 32 preferably of circular configuration having holes therein adapted to receive screws 13 (FIG. 4) for affixing to a liquid reservoir 7 which contains the alcohol and water. A portal 40 is provided on the reservoir 7 to allow addition of further liquid to replenish the supply. The vertical chamber 31 defines a central open area 21 which is filled with an absorbent material 22, preferably cotton wadding or an equivalent. The open area 21 is sealed at the top and the bottom by upper and lower plugs 34,33 respectively, and one wall of the vertical chamber is provided with a weep hole 23 for purposes to be defined later. A pipe 18 extends from the upper plug 34 through the lower plug 33 and down into the liquid reservoir, and the upper plug is set downwardly somewhat from flush engagement with the horizontal chamber 30 so that a shelf 19 is provided. Further, the upper plug 34 includes a bleed hole 20 to allow liquid mist formed after the engine has stopped running to recondense and sit on the shelf 19 and eventually bleed back down into the vertical chamber 31.

The right hand portion of FIG. 2 shows a further portion of the metering means which varies the amount of air allowed in the horizontal chamber. As shown therein, a sleeve 14 is slidably disposed within the horizontal chamber 30, the sleeve being provided with an L-shaped passageway 15, 16 oriented to communicate with an opening **16*a* on the horizontal chamber wall. A knob 24 is provided at a terminal portion of the sleeve outside of the chamber 30 so that rotation of the sleeve through the knob 24 varies the effect of opening 16, 16*a*, either by axial translation of the sleeve relative to the chamber, or by rotation. Once an ideal air inlet dimension has been determined, this air bleed is allowed to remain fixedly secured by means of lock means 17** shown as a set screw.

The injection means 10 seen best in FIG. 5, comprises a clamp 10 that extends over the vacuum conduit 9 that runs between a carburetor 11 and a positive crankcase ventilation valve V. The clamp 10 has a tightening ear **10*b* on one side thereof for secure retention on the conduit, and a nozzle receptor 10*a* extending upwardly therefrom for reception therein of a nozzle 12 which frictionally is attached to the tube 8. The nozzle 12 pierces the conduit 9 and is frictionally retained by the receptor 10*a* so that the vacuum provided by the carburetor 11** influences the mixture of alcohol, water and air taken from the metering means.

In use and operation therefore, once the appropriate ratio of alcohol to water has been made the introduction of an alcohol, water and air mist into the vacuum line reduces carbon build-up, unfreezes stuck rings, and cleans spark plugs, such that an octane and engine improvement can be readily perceived. Most beneficially, it has been found that an alcohol to water ratio ranging from 1 to 5 parts of alcohol to 20 parts of water, and the dimension of the reservoir 7 is such that 3 or 4 ounces of the liquid will provide months of service.

The physical effect by which this mechanism operates can now be readily defined. Air passing through the variable opening 16*a* provides a venturi effect across the pipe 18 causing the mixed alcohol and water to be introduced to the air in the horizontal chamber 30. Under the impetus of the vacuum the mixture is directed to the vacuum conduit 9 and thence into the carburetor 11.

Further, having thus described the invention, it should be apparent that numerous structural modifications are contemplated as being part of this invention as set fort hereinabove and defined hereinbelow by the claims.

What is claimed is:

1. A vacuum responsive injection system for engines comprising, in combination:

a vacuum conduit extending from a carburetor to a crankcase ventilation valve, injection means in the vacuum conduit connected to a metering means through a tube, said metering means operatively attached to a liquid containing reservoir whereby air and liquid are injected into the carburetor as an aerated liquid through the vacuum conduit after premixing with unburned oil-carbon crankcase vapors in the vacuum conduit wherein said metering means comprises:

a horizontal chamber communicating with a vertical chamber which overlies said reservoir, a pipe supported by said vertical chamber and extending from said horizontal chamber into liquid in said reservoir, said pipe isolated from an open area defined by said vertical chamber, and an air bleed means in said horizontal chamber whereby liquid drawn up to said horizontal chamber by said pipe is mixed with air and carried to the carburetor.

2. The device of claim 1 wherein said air bleed means comprises an opening through a portion of said horizontal chamber, a sleeve slidably disposed within said horizontal chamber having an L-shaped internal passageway one end of which registers with said opening whereby displacement of said sleeve relative to the opening varies the air flow rate.

3. The device of claim 2 wherein lock means are provided for said sleeve to fixedly secure said sleeve in an optimal position relative to said horizontal chamber.

4. The device of claim 1 wherein said pipe is connected to said vertical chamber by spaced upper and lower plug elements through which said pipe is secured, said upper plug is disposed slightly below said horizontal chamber and defines a shelf and includes a bleed hole to allow excess liquid to seep therethrough into said vertical chamber and a weep hole through said vertical chamber to allow drainage of excess liquid.

5. The device of claim 4 wherein a liquid absorbent is provided in said vertical chamber.

6. The device of claim 5 wherein said injection means comprises:

a clamp fixed to the vacuum conduit, a nozzle receptor formed on said clamp, a nozzle frictionally disposed within said nozzle receptor and extending within the vacuum conduit, said nozzle frictionally engaging said tube at one extremity thereof, said tube frictionally disposed within said horizontal chamber remote from said air bleed means.

7. The device of claim 6 wherein said liquid is alcohol and water in a ratio range of from 1 to 5 parts alcohol to 20 parts water.

8. The device of claim 7 wherein said metering means is affixed to said reservoir on a top surface thereof by means of a radially extending flange emanating from a lower area of said vertical chamber, screws attaching said flange to said reservoir, said reservoir including a port for adding liquid.

9. The device of claim 8 wherein said lock means comprises a screw which affixes said sleeve to said horizontal chamber, and said sleeve includes a knob for displacing said opening.

* * * * *